US007338154B2

(12) United States Patent
Hasebe et al.

(10) Patent No.: US 7,338,154 B2
(45) Date of Patent: Mar. 4, 2008

(54) IMAGE RECORDING APPARATUS

(75) Inventors: Takashi Hasebe, Sagamiko-machi (JP); Saburo Shimizu, Hachioji (JP); Takeo Arai, Hachioji (JP); Satoshi Masumi, Hino (JP); Tetsu Sekine, Sagamihara (JP); Shuta Hamada, Hachioji (JP)

(73) Assignee: Konica Minolta Holdings, Inc., Tokyo (JP)

( * ) Notice: Subject to any disclaimer, the term of this patent is extended or adjusted under 35 U.S.C. 154(b) by 274 days.

(21) Appl. No.: 10/806,155

(22) Filed: Mar. 23, 2004

(65) Prior Publication Data

US 2004/0189771 A1 Sep. 30, 2004

(30) Foreign Application Priority Data

Mar. 25, 2003 (JP) ..... 2003-081902
Mar. 25, 2003 (JP) ..... 2003-081905

(51) Int. Cl.
*B41J 2/01* (2006.01)

(52) U.S. Cl. ..... 347/102; 347/101

(58) Field of Classification Search ..... 347/102, 347/101, 42; 101/488
See application file for complete search history.

(56) References Cited

U.S. PATENT DOCUMENTS 5,371,531 A * 12/1994 Rezanka et al. ..... 347/43
6,003,988 A * 12/1999 McCann et al. ..... 347/101
6,145,979 A * 11/2000 Caiger et al. ..... 347/102
6,428,142 B1 * 8/2002 Silverbrook et al. ..... 347/42
6,562,413 B1 * 5/2003 Morgavi ..... 427/466
6,637,860 B1 * 10/2003 Madeley ..... 347/42
6,834,948 B2 * 12/2004 Asano et al. ..... 347/102
7,175,712 B2 * 2/2007 Siegel ..... 118/620
2001/0020960 A1 * 9/2001 Ikemoto et al. ..... 347/13
2003/0184632 A1 * 10/2003 Suzuki et al. ..... 347/102
2003/0222961 A1 * 12/2003 Nakajima ..... 347/102

* cited by examiner

*Primary Examiner*—Stephen Meier
*Assistant Examiner*—Leonard Liang
(74) *Attorney, Agent, or Firm*—Finnegan, Henderson, Farabow, Garrett & Dunner, L.L.P.

(57) ABSTRACT

An image printing apparatus including a conveyance-printing section for printing on a recording medium sheet; a first printing device including a plurality of black printing heads for jetting image-setting black ink drops onto the recording medium sheet; a second printing device including a plurality of color printing heads for jetting image-setting color ink drops onto the recording medium sheet; first light radiating devices which radiate ultraviolet rays to harden the image-setting black ink drops; and second light radiating devices which radiate the ultraviolet rays to harden the image-setting color ink drops.

4 Claims, 8 Drawing Sheets

IMAGE RECORDING APPARATUS

BACKGROUND OF THE INVENTION

The present invention relates to an image recording apparatus, and in particular, to an image recording apparatus in which image-setting ink is employed.

In recent years, a great number of the image recording apparatuses using ink-jet recording methods have been used. Because the ink-jet recording method can form images very conveniently at low cost, compared to a method in which a plate-making is required, such as a photogravure printing and a flexographic printing.

Further, in the field where images are recorded on commercial products or on their packaging by the ink-jet method, materials such as resin and metal, having no ink absorbing property, are often used for commercial products and their packaging. In order to fix ink drops on a recording medium sheet having no ink absorbing property, image-setting ink is used. Namely, well known is an image recording apparatus using such image-setting ink, wherein after the image-setting ink drops are jetted onto the recording medium sheet, light rays such as ultraviolet light are radiated so that ink drops are hardened and fixed (see Patent Document 1).

In the image recording apparatus, a conveyance unit (which is a conveyance-print device) is disposed which conveys the recording medium sheet, and a plurality of line type printing heads which jet the image-setting ink drops, are arranged above a conveyance path on which the recording medium sheet is fed. Further on the down stream side of the printing heads, with respect to the conveyance direction, a light radiating device is arranged which radiates light rays onto the ink drops jetted from the printing heads, and thereby hardens the ink drops.

In such an image recording apparatus, it is actualized that, while the recording medium sheet is conveyed by the conveyance unit, the ink drops are jetted from the printing heads onto the recording medium sheet, based on predetermined image information, and after which, the light rays from the light radiating device are radiated onto the ink drops, which have landed on the recording medium sheet, and therefore, the ink drops are hardened and fixed on the recording medium sheet.

[Patent Document 1] Tokkai 2002-347232

However, in the image recording apparatus mentioned above, the distance between the light radiating device to each printing head differ. Therefore, the time intervals from an ink drop landed time to a light radiated time also differ for each printing head, resulting in the mixture of the landed color ink and the landed black ink before hardening. Since a text character is generally recorded in black ink, if color or black ink are mixed, specifically when the character is recorded on the recording medium sheet, edges of the black text character become blurred at the area where the black recording overlaps the color recording, resulting in deterioration of text character quality, which is not preferable.

SUMMARY OF THE INVENTION

The objective of the present invention is to provide an image recording apparatus which is capable of producing high quality of text characters which have been printed in black ink.

Further, the objective of the present invention is to provide an image recording apparatus which is capable of improving the sharpness of the color image and sharpening the image quality. The objective of the present invention can be attained by the structures described below.

Structure 1.

An image recording apparatus, including:

a conveyance-print device wherein printing is performed on a recording medium sheet while the recording medium sheet is conveyed; and a plurality of printing heads, which jet image-setting ink onto the recording medium sheet, are arranged in a direction perpendicular to the conveyance direction of the recording medium sheet;

wherein at least one of the printing heads among the plural printing heads is a black printing head for jetting black ink drops, and the other printing heads except for the black printing head are color printing heads for jetting color ink drops, and wherein a plurality of the printing heads are aligned in the conveyance direction so that all of the color printing heads are arranged downstream of the black printing head with respect to the conveyance direction of the recording medium sheet, and wherein a first light radiating device, arranged downstream of the black printing head, radiates light rays onto the black ink drops landed on the recording medium sheet, and hardens the black ink drops, and wherein a second light radiating device, arranged downstream of the color printing head which is located most downstream among all the color printing heads, radiates the light rays onto the color and black ink drops landed on the recording medium sheet, and hardens the color and black ink drops.

According to structure 1, since the first light radiating device is arranged downstream of the black printing head, before the color ink drops are ejected, the first light radiating device radiates light rays onto the black ink drops which have been landed on the recording medium sheet, and thereby the black ink drops are hardened. Further, since the second light radiating device is arranged downstream of the color printing head which is most downstream among all of the color printing heads, the second light radiating device radiates the light rays onto the color ink drops which landed on the recording medium sheet after the black ink have been hardened, and then the color ink drops are also hardened. Accordingly, the color and black ink drops are hardened without being contaminated, resulting in improvement of image quality of the text characters printed in black ink.

Structure 2.

The image recording apparatus in Structure 1, wherein the second light radiating device radiates light energy which is greater than the light energy radiated from the first light radiating device.

Generally, a color image is reproduced by plural color inks such as Y (yellow), M (magenta), and C (cyan), or R (red), G (green), and B (blue). Namely, for the reproduction of color images, the amount of the ejected color ink drops is relatively greater than the amount of the ejected black ink drops, therefore, in order to harden the color ink drops, the light energy radiated onto the color ink drops must be greater than that radiated onto the black ink. Due to this, in Structure 2, the second light radiating device radiates light energy which is greater than that radiated from the first light radiating device, which assured the desired results in the hardening of the color ink.

Structure 3.

An image recording apparatus, including:

a conveyance device for conveying a recording medium sheet; and a plurality of printing heads wherein a plurality of unit heads, which jet image-setting ink onto the recording medium sheet, are arranged in a direction perpendicular to the conveyance direction of the recording medium sheet;

wherein at least one of the printing heads among the plural printing heads is a black printing head for jetting black ink drops, and the other printing heads except for the black printing head are color printing heads for jetting color ink drops, wherein a plurality of the printing heads are aligned in the conveyance direction of the recording medium sheet so that all of the color printing heads are arranged upstream of the black printing head with respect to the conveyance direction of the recording medium sheet, and wherein a first light radiating device, arranged downstream of the color printing head which is located most downstream among all the color printing heads, radiates the light rays onto the color ink drops landed on the recording medium sheet, and hardens the color ink drops, and wherein a second light radiating device, arranged downstream of the black printing head, radiates light rays onto the black and color ink drops landed on the recording medium sheet, and hardens the black ink and color ink drops.

According to structure 3, since the first light radiating device is arranged downstream of the color printing head which is most downstream among all of the color printing heads, before the black ink drops are ejected, the first light radiating device radiates light rays onto the color ink drops which have been landed on the recording medium sheet, and thereby the color ink drops are hardened. Further, since the second light radiating device is arranged downstream of the black printing head, the second light radiating device radiates the light rays onto the black ink drops landed on the recording medium sheet after the color ink drops have been hardened, and then the black ink drops are also hardened. Accordingly, the color and black ink drops are hardened without being mixed. Specifically, the black ink drops are landed after the color ink drops have been hardened, resulting in improvement of image quality, and thereby, the color images having the sharp image quality are produced.

Structure 4.

The image recording apparatus in Structure 3, wherein the first light radiating device radiates light energy which is greater than the light energy radiated from the second light radiating device.

Generally, a color image is reproduced by plural color inks such as Y (yellow), M (magenta), and C (cyan), or R (red), G (green), and B (blue). Namely, for the reproduction of color images, the amount of the ejected color ink drops is relatively greater than the amount of the ejected black ink drops, therefore, in order to harden the color ink drops, the light energy radiated onto the color ink drops must be greater than that radiated onto the black ink. Due to this, in Structure 3, the first light radiating device radiates light energy which is greater than that radiated from the second light radiating device, which assured the desired results in the hardening of the color ink.

DETAILED DESCRIPTION OF THE PREFERRED EMBODIMENT

Preferred embodiments of the present invention will now be explained in detail below, referring to FIGS. 1-8.

First Embodiment

Figure 1:
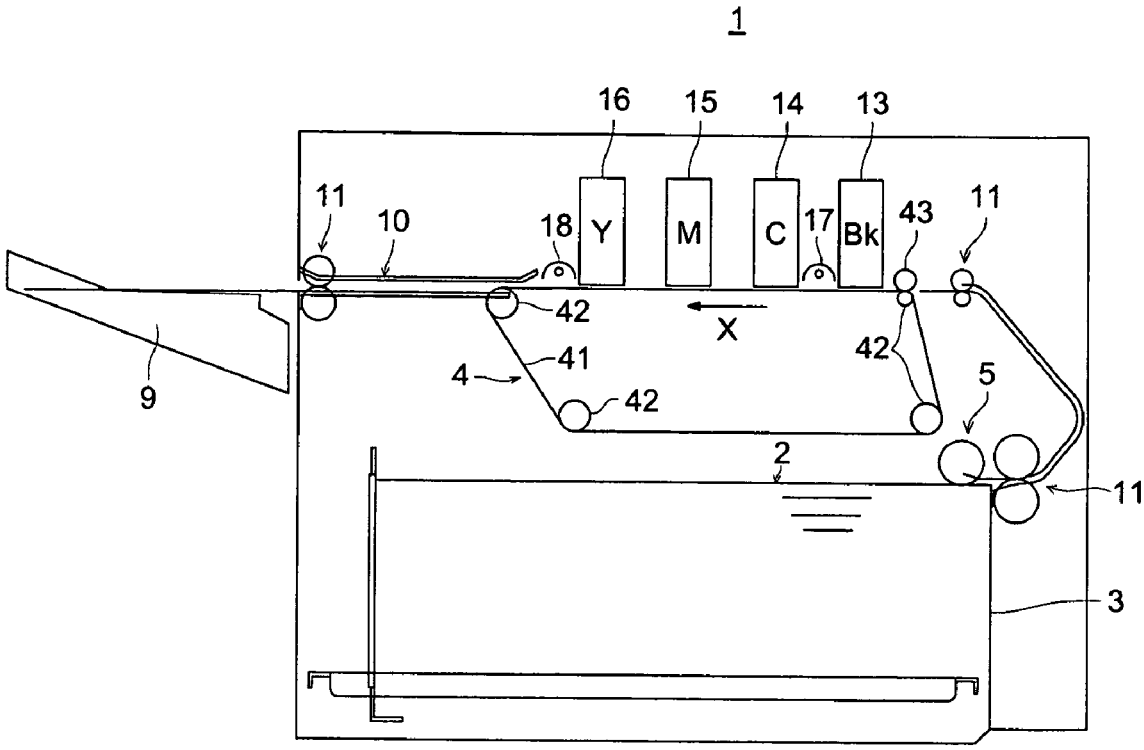
FIG. 1 is a schematic view of an image recording apparatus in a first embodiment of the present invention.

FIG. 1 is a drawing of a first embodiment of the image recording apparatus relating to the present invention. In a lower interior portion of image recording apparatus 1, accommodation tray 3 is provided on which plural recording media sheets 2 are stacked. Above one of the ends of accommodation tray 3, take-up device 5 is provided which takes up recording media sheets 2 one by one, on which images are to be recorded, from accommodation tray 3. In this case, concerning recording media sheets 2, it is possible to employ cut sheets selected from various kinds of paper such as plain paper, recycled paper, and glossy paper, various kinds of cloth, various kinds of bonded textiles, and cut sheet of materials such as resin, metal, and glass.

Above accommodation tray 3, conveyance device 4 is provided which conveys recording media sheets 2. In this conveyance device 4, endless conveyance belt 41 rotates about entrained plural rollers 42 so that conveyance belt 41 makes it possible to convey recording media sheets 2 in a flat manner, in the horizontal direction. Further in conveyance device 4, at the contacting section of conveyance belt 41 and recording medium sheet 2, rotating pressure roller 43 presses against conveyance belt 41 is provided so that recording media sheets 2 can be conveyed in a flat state.

On a side section of image recording apparatus, output tray 9 is provided which receives ejected recording media sheets 2 carrying recorded images.

In image recording apparatus 1, conveyance path 10 is provided, by which recording media sheet 2 supplied from accommodation tray 3 is conveyed to conveyance belt 41, and after recording media sheet 2 is conveyed through a train of conveyance belt 41, recording media sheet 2 is ejected from conveyance belt 41 to output tray 9. At predetermined positions of conveyance path 10, a plurality of paired conveyance rollers 11 are provided.

Above, and adjacent to conveyance belt 41, a plurality of printing heads 13, 14, 15, and 16 are provided across the full width of conveyance belt 41 so that ink can be jetted onto recording media sheets 2. At least one of printing heads 13, 14, 15, and 16, that is, printing head 13 is a black printing head which ejects black ink (BK), and printing heads 14, 15, and 16 are color printing heads which eject color ink of cyan (C), magenta (M), and yellow (Y), respectively. In this case, the color ink includes not only basic colors of C, M, and Y of the subtractive mixture, but also dark and light colors which record the dark and light of the basic colors of C, M, and Y, that is, includes ink for all colors except for the black ink for black coloring.

Further, printing heads 13, 14, 15, and 16 are arranged along conveyance direction X so that all color printing heads are arranged downstream of the black printing head. Specifically, printing heads 13, 14, 15, and 16 are arranged in conveyance direction X in the order of black, cyan, magenta, and yellow, so that each ink can be ejected onto recording media sheets 2. Concerning printing heads 13, 14, 15, and 16, a line method is preferably employed so that the ejecting surfaces are arranged to face the peripheral surface of conveyance belt 41.

Figure 2:
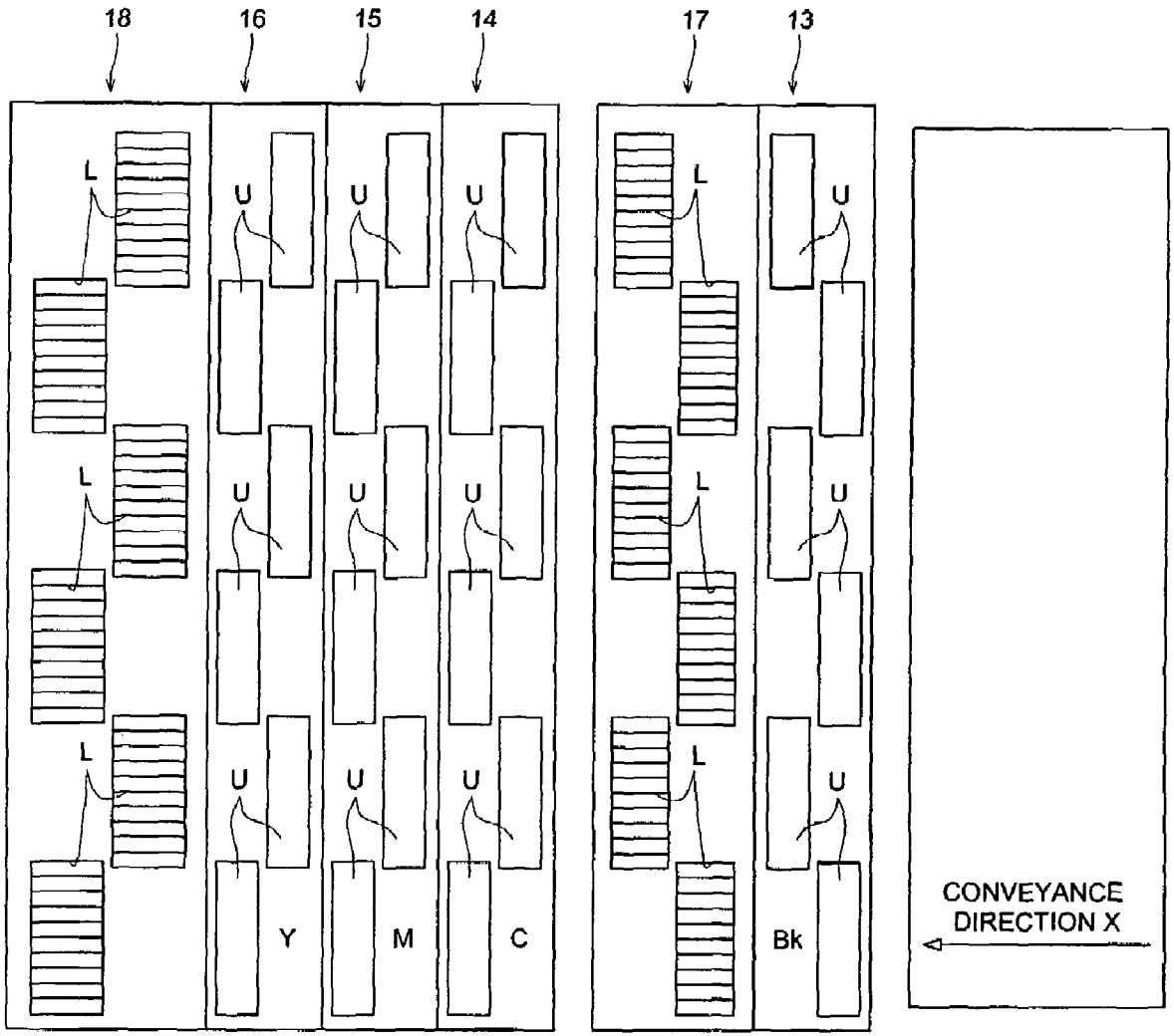
FIG. 2 is a top view of a printing head and a light radiating device of the first embodiment of the image recording apparatus.
Figure 3:
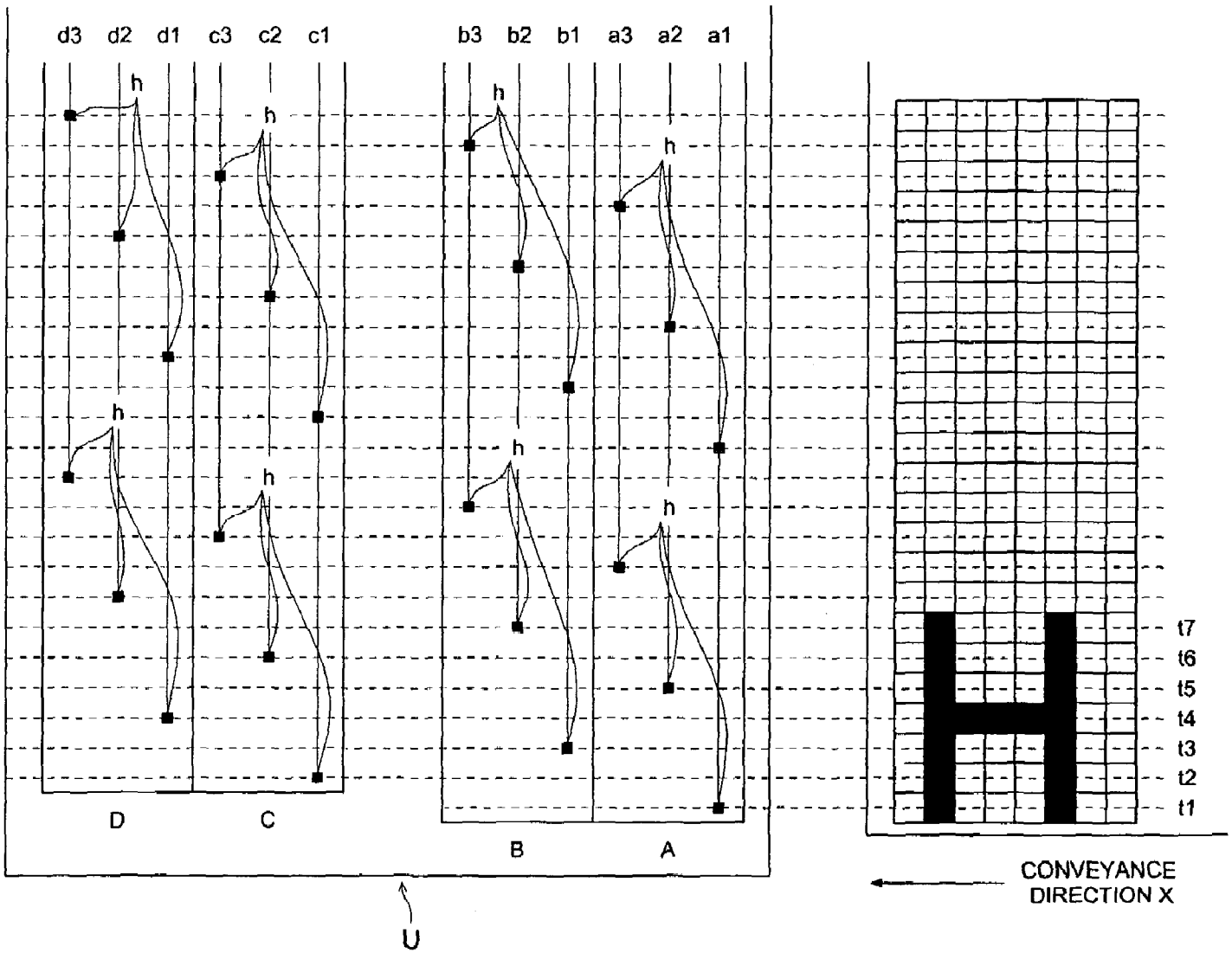
FIG. 3 is a bottom view showing the distribution of nozzles of unit heads provided in the printing head in the first and second embodiments.
Figure 4:
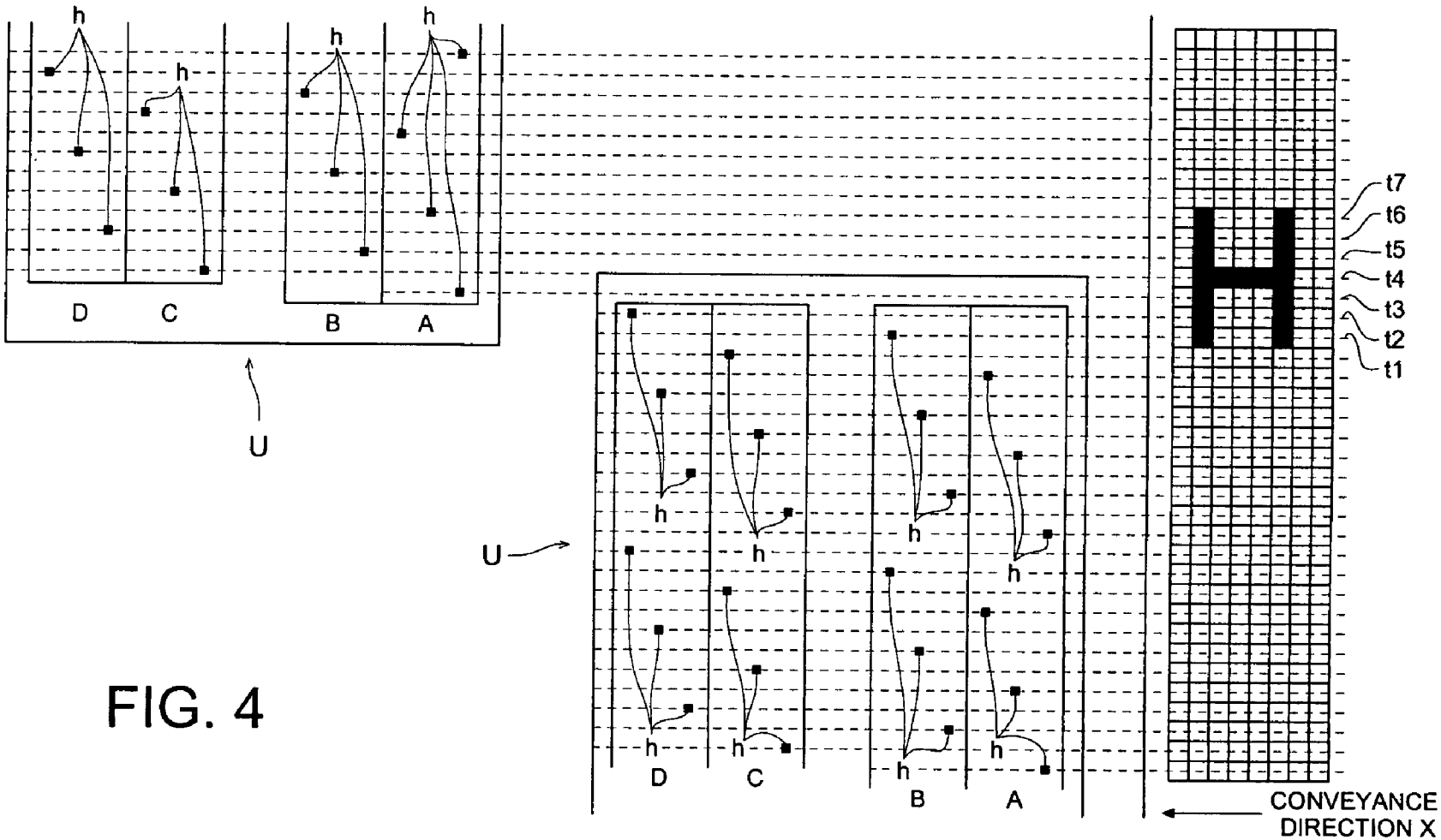
FIG. 4 is a bottom view showing the distribution of nozzles of the plural unit heads in the first and second embodiments.

FIG. 2 is a plan view of printing heads 13, 14, 15, and 16. For each of printing heads 13, 14, 15, and 16, plural unit heads U for jetting ink drops, are staggered perpendicular to conveyance direction X. FIGS. 3 and 4 are explanatory drawings showing the arrangement of nozzles h provided in unit head U. As shown in FIGS. 3 and 4, on the ejecting surface of unit head U facing recording media sheets 2, nozzles h are aligned in four lines A-D. Based on the conveyance of recording media sheets 2, from each nozzle row A-D of unit head U, the ink drops are ejected in the order of row a1, row a2, and row a3 for row A; row b1, row b2, and row b3 for row B; row c1, row c2, and row c3 for row C; and row d1, row d2, and row d3 for row D. In each of rows A-D, nozzles h are arranged in such a way that they are composed of nozzle groups comprising three nozzles, each group being arranged at specified intervals in the direction perpendicular to conveyance direction X, and in each group, the three nozzles are deviated in the conveyance direction X at a specified pitch and also in the direction perpendicular to X at the above-mentioned interval. Further, the starting points of the rows A to D are deviated by one pixel in the direction perpendicular to conveyance direction X in the order of A, C, B, and D. By ejecting ink drops from each nozzle h arranged in the above-mentioned way, images can be recorded onto recording media sheets 2.

For example, in the case that letter "H" is to be recorded, as regards the lines forming the letter "H", as shown in FIG. 3, the ink drops are jetted from each nozzle h. That is, for line t1, ink drops are jetted from $1^{st}$ nozzle h of row A. For line t2, ink drops are jetted from $1^{st}$ nozzle h of row C. For line t3, ink drops are jetted from $1^{st}$ nozzle h of row B. For line t4, ink drops are jetted from $1^{st}$ nozzle h of row D. For line t5, ink drops are jetted from $2^{nd}$ nozzle h of row A. For line t6, ink drops are jetted from $2^{nd}$ nozzle h of row C. And for line t7, ink drops are jetted from $2^{nd}$ nozzle h of row B.

Still further, in the case that letter "H" is to be recorded by plural unit heads U, regarding the lines forming the letter "H", as shown in FIG. 4, the ink drops are jetted from each nozzle h of unit head U as shown in FIG. 4. That is, for line t1, the ink drops are jetted from $1^{st}$ nozzle h counted from the top of row B of unit head U, shown in a lower drawing in FIG. 4. For line t2, the ink drops are jetted from $1^{st}$ nozzle h counted from the top of row D of unit head U, shown in the lower drawing in FIG. 4. For line t3, ink is ejected from $1^{st}$ ejecting mouth h counted from the bottom of row A of unit head U, shown in an upper drawing in FIG. 4. For line t4, the ink drops are jetted from $1^{st}$ nozzle h counted from the bottom of row C of unit head U, shown in the upper drawing in FIG. 4. For line t5, the ink drops are jetted from $1^{st}$ nozzle h counted from the bottom of row B of unit head U, shown in the upper drawing in FIG. 4. For line t6, the ink drops are ejected from $1^{st}$ nozzle h counted from the bottom of row D of unit head U, shown in the upper drawing in FIG. 4. And for line t7, the ink drops are jetted from 2nd nozzle h counted from the bottom of row A of unit head U, shown in the upper drawing in FIG. 4.

As shown in FIG. 1, in the upper neighborhood of conveyance belt 41 and downstream of printing head 13, with respect to conveyance direction X, first light radiating device 17 is provided for radiating light onto the black ink drops landed onto recording medium sheet 2, which hardens the surface of the black ink drops.

Still further, in the upper neighborhood of conveyance belt 41 and downstream of printing head 13, with respect to conveyance direction X, second light radiating device 18 is provided for radiating light onto cyan, magenta, yellow, and black ink drops, landed on recording medium sheet 2, which hardens the surface of these ink drops.

In addition, between the specific ink jetting heads for each color ink and the light radiating devices for each color, the following relationship exists. That is, the distances between unit module U of the ink jetting head and unit module L of the light radiating device, which corresponds to unit module U of the ink jetting head, are equal for the same color ink. Therefore, the time interval between the ink jetting and the light radiation is set to be equal for each color. Since the distance between the ink jetting module and the light radiating module of each color is equal, there is no difference in the starting times of ink hardening, and thereby deterioration of the image quality is prevented.

On first light radiating device 17 and second light radiating device 18 shown in FIG. 2, a plurality of light sources for radiating the light are staggered perpendicular to conveyance direction X, and correspond to each of plural unit heads U. Though there is no limitation about light source L, it is preferable to arrange LED (a light emitting diode) arrays to emit the ultraviolet rays, across the full width of conveyance belt 41.

The amount of the radiated light from first light radiating device 17 is determined in such a way that the light amount can assuredly harden the surface of the dots of ink by preserving the predetermined diameter of dots of ejected black ink, jetted from printing head 13 and landed on recording media sheets 2. On the other hand, the amount of radiated light from second light radiating device 18 is determined in such a way that the light amount can absolutely harden the black ink and the color ink, landed on recording media sheets 2.

When a color image is reproduced, the amount of jetted color ink is greater than that of jetted black ink. Therefore, in order to harden the jetted color ink, the radiating light energy for hardening the jetted color ink must be greater than that for hardening the jetted black ink. Accordingly, it is actualized that second light radiating device 18 radiates more light energy than that radiated from first light radiating device 17. In this case, concerning the setting of the light energy radiated from first light radiating device 17 and second light radiating device 18 both of which can change their light energy, the light energy radiated from first light radiating device 17 and second light radiating device 18 are controlled by a control device so that the above-mentioned relationship is obtained. For example, when light source L is a LED, the light energy is controlled by controlling the electrical current, while when light source L is a fluorescent tube, the light energy is controlled by controlling the electrical voltage. On the other hand, concerning the light radiating device wherein the light energy is not changed, that is, concerning the light radiating device which can radiate only unchangeable light energy, a plurality of the light radiating devices which radiate different amounts of light energy are arranged so that the above-mentioned relationship is obtained. It is also possible to control the radiating area by a slit, in order to change the light energy.

Besides, the inks to be used in this embodiment are inks that are hardened by the radiation of light, in particular, inks of an ultraviolet-setting type that are hardened by the radiation of ultraviolet rays. Inks of an ultraviolet-setting type are generally classified into inks of a radical polymerization type containing a compound capable of radical polymerization as a polymerizable compound, and inks of a cation polymerization type containing a compound capable of cation polymerization; both of these types of ink can be employed for the ink to be used in this embodiment, and it is also appropriate to employ an ink of a hybrid type composed of an ink of a radical polymerization type and an ink of a cation polymerization type combined for the ink to be used in this embodiment.

Figure 5:
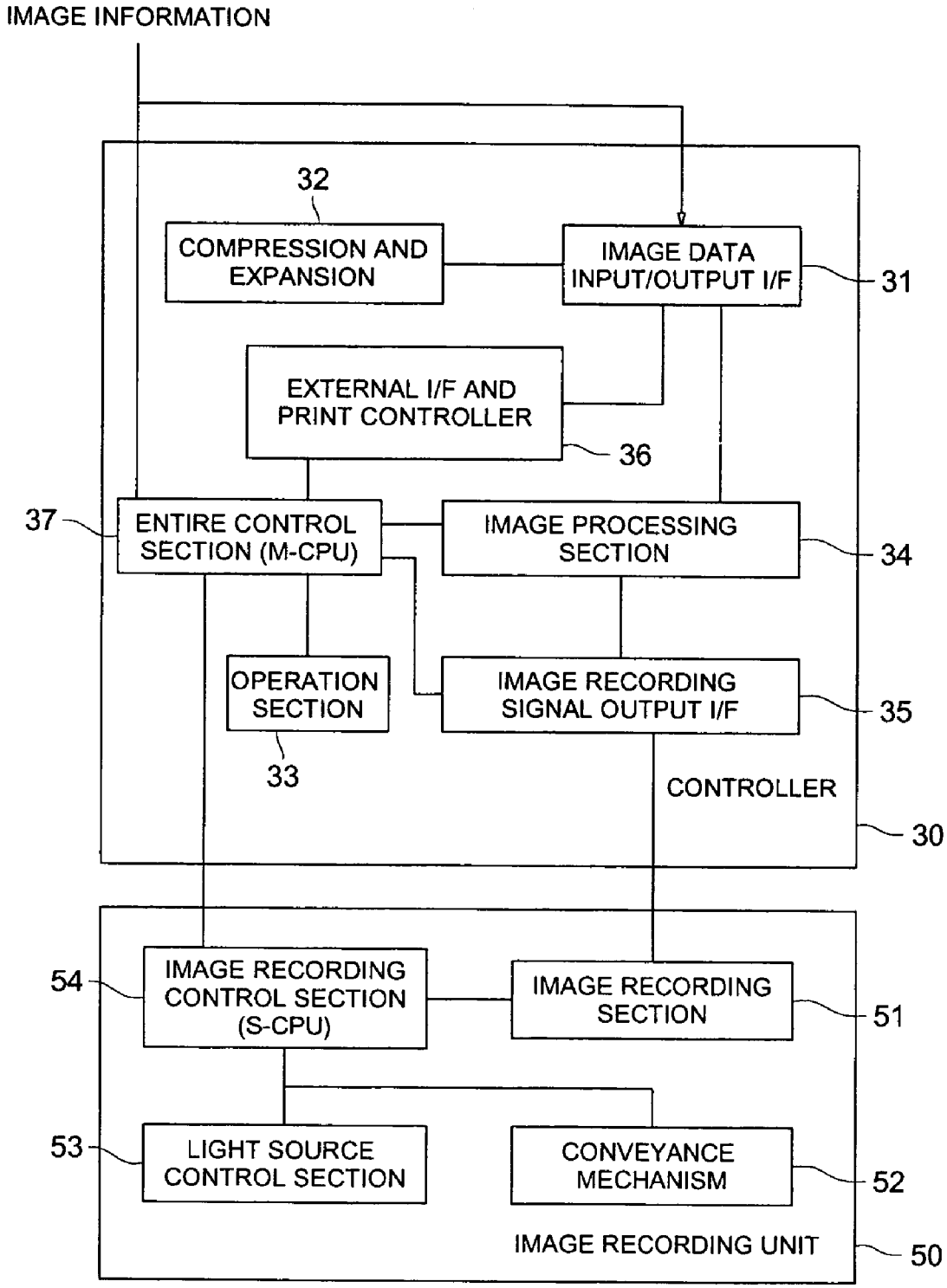
FIG. 5 is a block chart of a main control section of the image recording apparatus in the first and second embodiments.

FIG. 5 is a drawing showing a control device for controlling image recording apparatus 1 in this embodiment of the invention; this control device is composed of, for example, a CPU, a ROM, and a RAM (none of which are shown in the drawing), and comprises a controller 30 for developing any one of the processing programs stored in the ROM and carrying out this processing program by the CPU.

In controller 30, provided are an image data input and output I/F 31 for receiving image information transmitted to the image recording apparatus, and compression/expansion section 32 for compressing transferred image data by page units, to store them therein, and further expanding the compressed image data, to store them therein. For the compression/expansion means in this case, JPEG, JPEG2000, JBIG, etc., known to the public can be used. In controller 30, provided are operation section 33 for a user to carry out the inputting of the desired number of output sheets, the number of output sheets sets, etc., by operation, image processing section 34 to transform image data obtained into data adapted to the image output format, and image recording signal output I/F 35 to output the image data transformed in image processing section 34 to image recording section 51 of image recording unit 50. Further, in controller 30, provided is an external I/F and print controller 36 for taking in an image obtained by means of an image pickup apparatus such as a digital camera or image data read by another reading apparatus, and then carrying out image recording based on instructions from an external apparatus. Further, in controller 30, provided is entire control section (M-CPU) 37 for controlling the operation of image processing section 34, image recording signal output I/F 35 and external I/F and print controller 36 in accordance with operation section 33 and the above-mentioned image information.

In image recording unit 50, provided are image recording section 51 to carry out image recording in accordance with signals from image recording signal output I/F 35, conveyance mechanism 52 to operate conveyance rollers 11 and tension rollers 42, light source control section 53 to control the output of light radiation devices 17 and 18 in accordance with a control signal from image recording section 51, and image recording control section (S-CPU) 54 to control the operation of the above-mentioned structural constituents.

Figure 6:
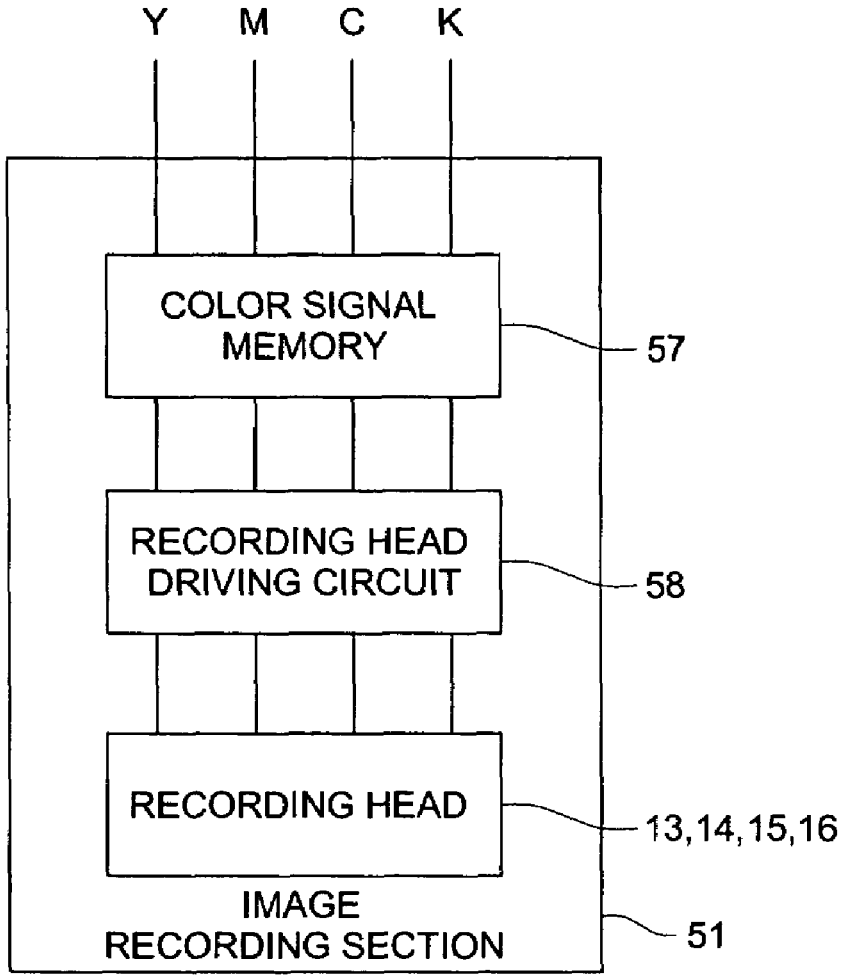
FIG. 6 is a block chart showing the structure of an image recording section in the first and second embodiments.

FIG. 6 is a block diagram showing the detailed structure of image recording section 51. In this image recording section 51, provided are color signal storage 57 composed of a plurality of buffer storage devices provided for each color in order to store color signals transmitted from image recording signal output I/F 35 and a buffer storage control circuit to control the output from the buffer storage devices, and printing head driving circuit 58 to control the driving of the ink jetting operation of printing heads 13, 14, 15, and 16 on the basis of color signals outputted in accordance with the control by the above-mentioned buffer storage control circuit.

Next, the operation of the image recording apparatus of the first embodiment will be explained.

Firstly, the operation of normal image formation will be explained. When image forming instruction is inputted from operation section 33 and image information is transmitted to image recording apparatus 1, as shown in FIG. 5, the transmission of image information is made to the entire control section 37 of controller 30, and also to image processing section 34 through image data input and output I/F 31. Besides, image information is transmitted from an external apparatus or the like to entire control section 37 through external I/F and print controller 36.

Entire control section 37 starts the operation of the structural constituents of the controller 30 when image information has been transmitted to it. In addition, as regards the timing of starting of the operation, it is not limited to the time of input of image information, but it is also appropriate to start the operation when an input by the user is made from operation section 33 or when an input from an external apparatus is made through external I/F and print controller 36.

In image processing section 34, image processing is applied to image data to make the image information adaptable to the image output format, that is, to make image information optimum for an image recording apparatus using image-setting inks to record an image. Image data composed of color signals that have been subjected to the image processing are transmitted from image recording signal output I/F 35 to image recording section 51 of the image recording unit 50.

In addition, it is also possible to transmit image information prior to image processing from the image data input and output I/F 31 to compression/expansion section 32, to store the information therein. Besides, compression/expansion section 32 operates not only at the time image data have been transmitted from image processing section 34 but also at the time an operational input for the start of operation, or the like, has been made from an external apparatus through external I/F and print controller 36.

On the other hand, when image information is transmitted to image recording apparatus 1, image recording control section 54 of image recording unit 50 brings conveyance mechanism 52 and light source control section 53 into operation on the basis of the color signals stored in color signal storage 57 of image recording section 51. Accompanied by this operation, printing head driving circuit 58 brings printing heads 13, 14, 15, and 16 into operation. To state it concretely, conveyance mechanism 52 brings takeout device 5 into operation, to take out uppermost recording medium sheet 2 accommodated in accommodation tray 3, and brings conveyance rollers 11 into rotational operation to make them convey this recording medium sheet 2 having been taken out.

Further, when the leading edge of recording medium sheet 2 has reached conveyance belt 41, pressing roller 43 presses the leading edge portion of recording medium sheet 2 onto the circumferential surface of conveyance belt 41 to make it hold the sheet. Because conveyance belt 41 is made to revolve by tension rollers 42, recording medium sheet 2 is conveyed with the revolution. When recording medium sheet 2 is conveyed to the position of printing head 13, black ink drops are jetted from printing head 13, and immediately after that, the black ink drops are radiated by the light from first light radiation device 17, to be subjected to hardening. Subsequently, cyan ink drops are jetted from printing head 14, and the cyan ink drops are subjected to hardening by the radiation of light from second light radiation device 18. In the same way, printing head 15 is brought into operation to jet magenta ink drops onto recording medium sheet 2, and the ink drops are subjected to hardening by second light radiation device 18. After that, printing head 16 is brought into operation to jet yellow ink drops onto recording medium sheet 2, and all the ink drops which have been landed on recording medium sheet 2 are completely hardened.

After complete hardening, when the leading edge portion of recording medium sheet 2 is detached from the circumferential surface of conveyance belt 41, recording medium sheet 2 is conveyed by conveyance rollers 11, to be ejected onto output tray 9.

As explained up to now, by image recording apparatus 1 of the first embodiment of the invention, because first light radiation devices 17 is disposed downstream of black printing head (which is printing head 13) with respect to conveyance direction X, the black ink drops landed on recording media sheets 2 are radiated by first light radiating device 17 to be hardened before the color ink drops are jetted.

Further, because second light radiation devices 18 is disposed at the most downstream side of color printing head (which is printing head 16) among all of color printing heads which are printing heads 14, 15 and 16) with respect to conveyance direction X, the color ink drops, landed on recording medium sheet after the black ink drops have been hardened, are radiated by second light radiating device 18 to also be hardened. Therefore, color ink and black ink are not mixed but hardened individually, resulting in a higher text quality printed in black ink.

Still further, since second light radiating device 18 radiates light energy which is greater than that radiated from first light radiating device 17, it is possible to thoroughly harden the colored ink. The present invention is not limited to the above embodiments, but can be changed as appropriate.

Second Embodiment

Figure 7:
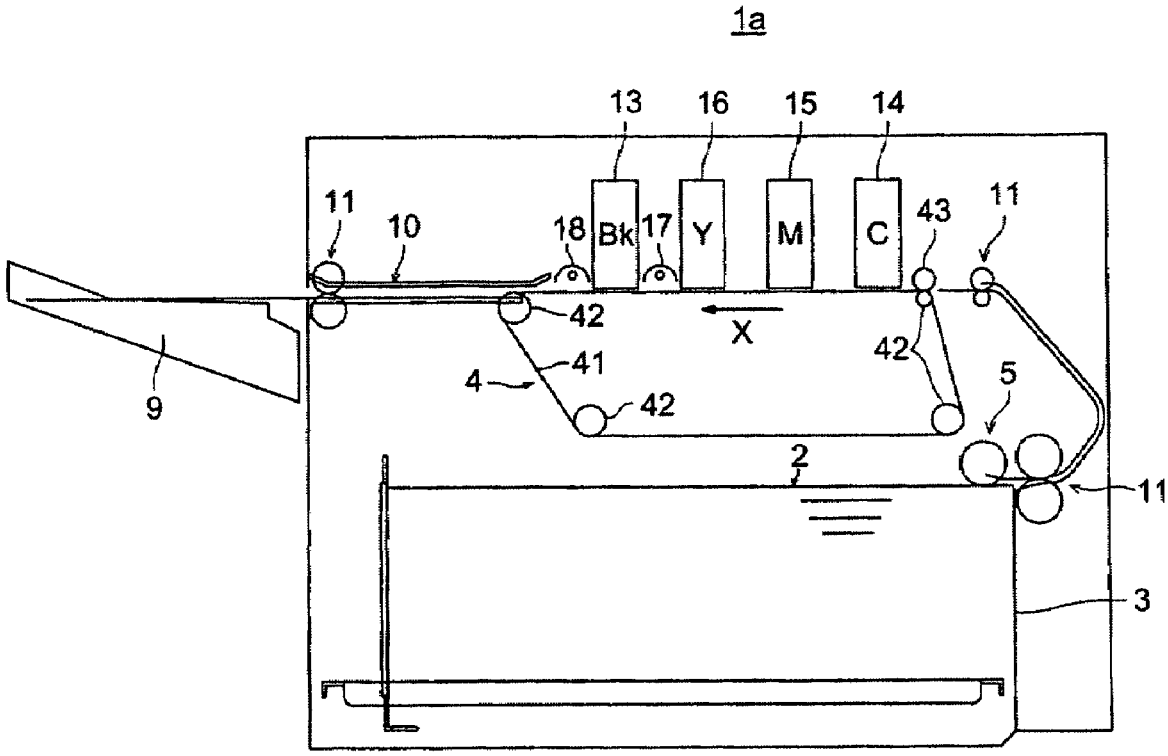
FIG. 7 is a schematic view of an image recording apparatus in the second embodiment.

FIG. 7 is a drawing of a second embodiment of the image recording apparatus 1*a* relating to the present invention. In a lower interior portion of image recording apparatus 1*a*, accommodation tray 3 is provided on which plural recording media sheets 2 are stacked. Above one of the ends of accommodation tray 3, take-up device 5 is provided which takes up recording media sheets 2 one by one, on which images are to be recorded, from accommodation tray 3. In this case, concerning recording media sheets 2, it is possible to employ cut sheets selected from various kinds of paper such as plain paper, recycled paper, and glossy paper, various kinds of cloth, various kinds of bonded textiles, and cut sheet of materials such as resin, metal, and glass.

Above accommodation tray 3, conveyance device 4 is provided which conveys recording media sheets 2. In this conveyance device 4, endless conveyance belt 41 rotates about entrained plural rollers 42 so that conveyance belt 41 makes it possible to convey recording media sheets 2 in a flat manner, in the horizontal direction. Further in conveyance device 4, at the contacting section of conveyance belt 41 and recording medium sheet 2, rotating pressure roller 43 presses against conveyance belt 41 is provided so that recording media sheets 2 can be conveyed in a flat state.

On a side section of image recording apparatus 1*a*, output tray 9 is provided which receives ejected recording media sheets 2 carrying recorded images.

In image recording apparatus 1*a*, conveyance path 10 is provided, by which recording media sheet 2 supplied from accommodation tray 3 is conveyed to conveyance belt 41, and after recording media sheet 2 is conveyed through a train of conveyance belt 41, recording media sheet 2 is ejected from conveyance belt 41 to output tray 9. At predetermined positions of conveyance path 10, a plurality of paired conveyance rollers 11 are provided.

Above, and adjacent to conveyance belt 41, a plurality of printing heads 14, 15, 16, and 13 are provided across the full width of conveyance belt 41 so that ink can be jetted onto recording media sheets 2. At least one of printing heads 14, 15, 16, and 13, that is, printing head 13 is a black printing head which ejects black ink (BK), and printing heads 14, 15, and 16 are color printing heads which eject color ink of cyan (C), magenta (M), and yellow (Y), respectively. In this case, the color ink includes not only basic colors of C, M, and Y, of the subtractive mixture, but also dark and light colors which record the dark and light of the basic colors of C, M, and Y, that is, includes ink for all colors except for the black ink for black coloring.

Further, printing heads 14, 15, 16 and 13 are arranged along conveyance direction X so that all color printing heads are arranged upstream of the black printing head. Specifically, printing heads 14, 15, 16 and 13 are arranged in conveyance direction X in the order of cyan, magenta, yellow and black so that each ink can be ejected onto recording media sheets 2. Concerning printing heads 14, 15, 16 and 13, a line method is preferably employed so that the ejecting surfaces are arranged to face the peripheral surface of conveyance belt 41.

Figure 8:
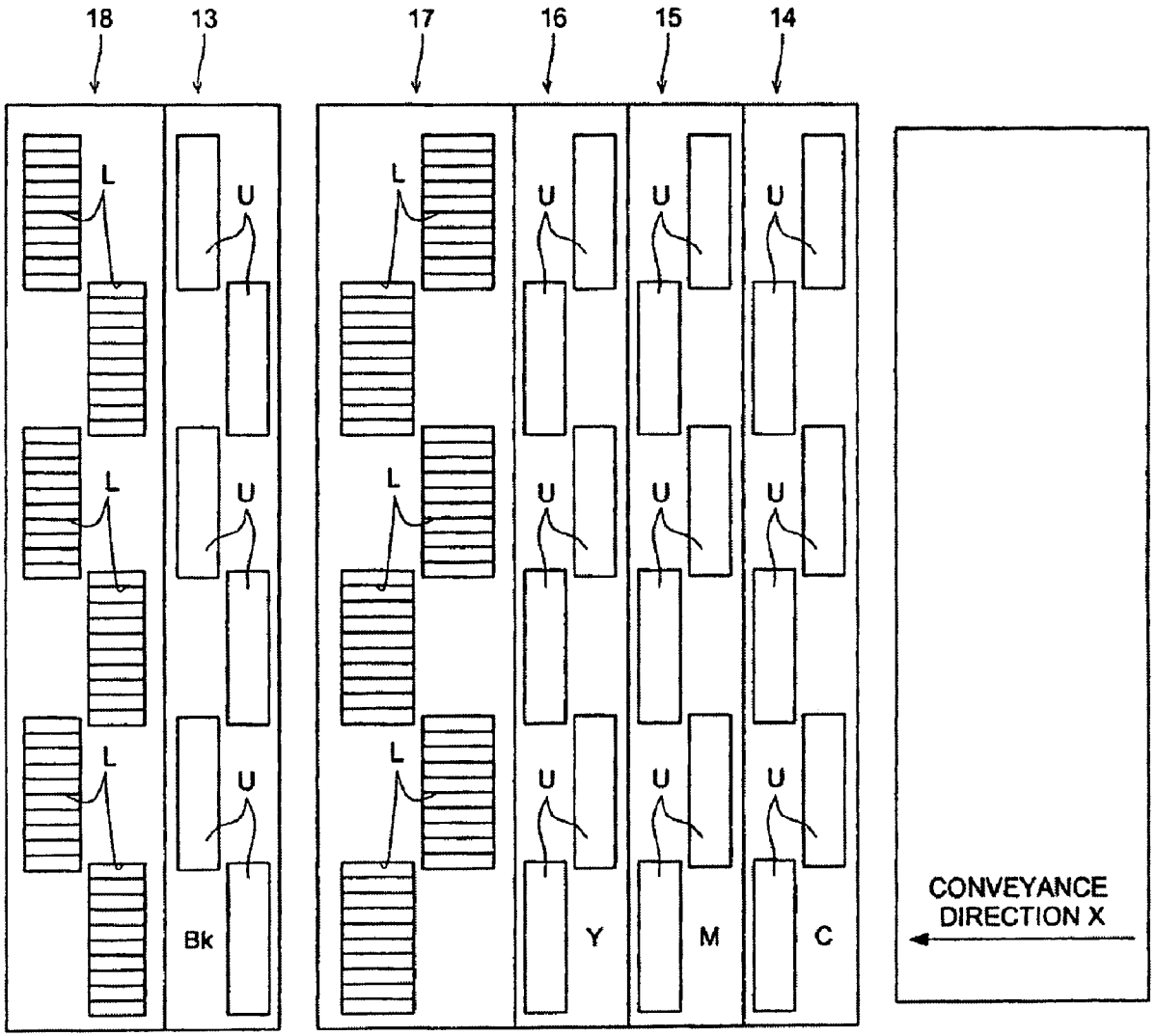
FIG. 8 is a top view of a printing head and a light radiating device of the image recording apparatus in the second embodiment.

FIG. 8 is a plan view of printing heads 13, 14, 15, and, 16. For each of printing heads 13, 14, 15, and 16, plural unit heads U for jetting ink drops, are staggered perpendicular to conveyance direction X. FIGS. 3 and 4 are explanatory drawings showing the arrangement of nozzles h provided in unit head U. As shown in FIGS. 3 and 4, on the ejecting surface of unit head U facing recording media sheets 2, nozzles h are aligned in four lines A-D. Based on the conveyance of recording media sheets 2, from each nozzle row A-D of unit head U, the ink drops are ejected in the order of row a1, row a2, and row a3 for row A; row b1, row b2, and row b3 for row B; row c1, row c2, and row c3 for row C; and row d1, row d2, and row d3 for row D. In each of rows A-D, nozzles h are arranged in such a way that they are composed of nozzle groups comprising three nozzles, each group being arranged at specified intervals in the direction perpendicular to conveyance direction X, and in each group, the three nozzles are deviated in the conveyance direction X at a specified pitch and also in the direction perpendicular to X at the above-mentioned interval. Further, the starting points of the rows A to D are deviated by one pixel in the direction perpendicular to conveyance direction X in the order of A, C, B, and D. By ejecting ink drops from each nozzle h arranged in the above-mentioned way, images can be recorded onto recording media sheets 2. That is, from each nozzle row of unit heads U for A-D, the ink drops are jetted in the order of row a1, row a2, and row a3 for A; row b1, row b2, and row b3 for B; row c1, row c2, and row c3 for C; and row d1, row d2, and row d3 for D.

For example, in the case that letter "H" is to be recorded, as regards the lines forming the letter "H", as shown in FIG. 3, the ink drops are jetted from each nozzle h. That is, for line t1, ink drops are jetted from $1^{st}$ nozzle h of row A. For line t2, ink drops are jetted from $1^{st}$ nozzle h of row C. For line t3, ink drops are jetted from $1^{st}$ nozzle h of row B. For line t4, ink drops are jetted from $1^{st}$ nozzle h of row D. For line t5, ink drops are jetted from $2^{nd}$ nozzle h of row A. For line t6, ink drops are jetted from $2^{nd}$ nozzle h of row C. And for line t7, ink drops are jetted from $2^{nd}$ nozzle h of row B.

Still further, in the case that letter "H" is to be recorded by plural unit heads U, regarding the lines forming the letter "H", as shown in FIG. 4, the ink drops are jetted from each nozzle h of unit head U as shown in FIG. 4. That is, for line t1, the ink drops are jetted from $1^{st}$ nozzle h counted from the top of row B of unit head U, shown in a lower drawing in FIG. 4. For line t2, the ink drops are jetted from $1^{st}$ nozzle h counted from the top of row D of unit head U, shown in the lower drawing in FIG. 4. For line t3, ink is ejected from $1^{st}$ ejecting mouth h counted from the bottom of row A of unit head U, shown in an upper drawing in FIG. 4. For line t4, the ink drops are jetted from $1^{st}$ nozzle h counted from the bottom of row C of unit head U, shown in the upper drawing in FIG. 4. For line t5, the ink drops are jetted from $1^{st}$ nozzle h counted from the bottom of row B of unit head U, shown in the upper drawing in FIG. 4. For line t6, the ink drops are ejected from $1^{st}$ nozzle h counted from the bottom of row D of unit head U, shown in the upper drawing in FIG. 4. And for line t7, the ink drops are jetted from $2_{nd}$ nozzle h counted from the bottom of row A of unit head U, shown in the upper drawing in FIG. 4.

As shown in FIG. 7, in the upper neighborhood of conveyance belt 41 and downstream of printing head 16, with respect to conveyance direction X, first light radiating device 17 is provided for radiating light onto the color ink drops of cyan, magenta, and yellow, landed onto recording medium sheet 2, which hardens the surface of the color ink drops.

Still further, in the upper neighborhood of conveyance belt 41 and downstream of printing head 13, with respect to conveyance direction X, second light radiating device 18 is provided for radiating light onto black ink drops and color ink drops, landed onto recording medium sheet 2, which hardens the surface of the black and color ink drops.

In addition, between the specific ink jetting heads for each color ink and the light radiating devices for each color, the following relationship exists. That is, the distances between unit module U of the ink jetting head and unit module L of the light radiating device, which corresponds to unit module U of the ink jetting head, are equal for the same color ink. Therefore, the time interval between the ink jetting and the light radiation is set to be equal for each color. Since the distance between the ink jetting module and the light radiating module of each color is equal, there is no difference in the starting times of ink hardening, and thereby deterioration of the image quality is prevented.

On first light radiating device 17 and second light radiating device 18 shown in FIG. 8, a plurality of light source for radiating the light are staggered perpendicular to conveyance direction X, and correspond to each of plural unit heads U. Though there is no limitation about light source L, it is preferable to arrange LED (a light emitting diode) array to emit the ultraviolet rays, across the full width of conveyance belt 41.

The amount of the radiated light from the first light radiating device 17 is determined in such a way that the light amount can assuredly harden the surface of the dots of ink by preserving the predetermined diameter of dots of ejected color ink, jetted from printing heads 14, 15 and 16, and landed on recording media sheets 2. On the other hand, the amount of radiated light from the second light radiating device 18 is determined in such a way that the light amount can absolutely harden the black ink and the color ink, landed on recording media sheets 2.

When a color image is reproduced, the amount of jetted color ink is greater than that of jetted black ink. Therefore, in order to harden the jetted color ink, the radiating light energy for hardening the jetted color ink must be greater than that for hardening the jetted black ink. Accordingly, it is actualized that the first light radiating device 17 radiates more light energy than that radiated from the second light radiating device 18. In this case, concerning the setting of the light energy radiated from the first light radiating device 17 and the second light radiating device 18, both of which can change their light energy, the light energy radiated from the first light radiating device 17 and the second light radiating device 18 are controlled by a control device so that the above-mentioned relationship is obtained. For example, when light source L is a LED, the light energy is controlled by controlling the electrical current, while when light source L is a fluorescent tube, the light energy is controlled by controlling the electrical voltage. On the other hand, concerning the light radiating device wherein the light energy is not changed, that is, concerning the light radiating device which can radiate only unchangeable light energy, a plurality of the light radiating devices which radiate different amounts of light energy are arranged so that the above-mentioned relationship is obtained. It is also possible to control the radiating area by a slit, in order to change the light energy.

Next, the operation of the image recording apparatus 1*a* of the second embodiment will be explained.

Firstly, the operation of normal image formation will be explained. When image forming instruction is inputted from operation section 33 and image information is transmitted to image recording apparatus 1*a*, as shown in FIG. 5, the transmission of image information is made to the entire control section 37 of controller 30, and also to image processing section 34 through image data input and output I/F 31. Besides, image information is transmitted from an external apparatus or the like to entire control section 37 through external I/F and print controller 36.

Entire control section 37 starts the operation of the structural constituents of the controller 30 when image information has been transmitted to it. In addition, as regards the timing of starting of the operation, it is not limited to the time of input of image information, but it is also appropriate to start the operation when an input by the user is made from operation section 33 or when an input from an external apparatus is made through external I/F and print controller 36.

In image processing section 34, image processing is applied to image data to make the image information adaptable to the image output format, that is, to make image information optimum for an image recording apparatus using image-setting inks to record an image. Image data composed of color signals that have been subjected to the image processing are transmitted from image recording signal output I/F 35 to image recording section 51 of the image recording unit 50.

In addition, it is also possible to transmit image information prior to image processing from the image data input and output I/F 31 to compression/expansion section 32, to store the information therein. Besides, compression/expansion section 32 operates not only at the time image data have been transmitted from image processing section 34 but also at the time an operational input for the start of operation, or the like, has been made from an external apparatus through external I/F and print controller 36.

On the other hand, when image information is transmitted to image recording apparatus 1*a*, image recording control section 54 of image recording unit 50 brings conveyance mechanism 52 and light source control section 53 into operation on the basis of the color signals stored in color signal storage 57 of image recording section 51. Accompanied by this operation, printing head driving circuit 58 brings printing heads 14, 15, 16 and 13 into operation. To state it concretely, conveyance mechanism 52 brings takeout device 5 into operation, to take out uppermost recording medium sheet 2 accommodated in accommodation tray 3, and brings conveyance rollers 11 into rotational operation to make them convey this recording medium sheet 2 having been taken out.

Further, when the leading edge of recording medium sheet 2 has reached conveyance belt 41, pressing roller 43 presses the leading edge portion of recording medium sheet 2 onto the circumferential surface of conveyance belt 41 to make it hold the sheet. Because conveyance belt 41 is made to revolve by tension rollers 42, recording medium sheet 2 is conveyed with the revolution. When recording medium sheet 2 is conveyed to the position of printing head 14, cyan ink drops are jetted onto recording medium sheet 2 from printing head 14. Subsequently, magenta ink drops are jetted from printing head 15 onto recording medium sheet 2, and next, yellow ink drops are also jetted from printing head 16 onto recording medium sheet 2. After that, all color ink drops jetted onto the recording medium sheet 2 are hardened by the first light radiating device 17.

In the same way, printing head 13 is brought into operation to jet black ink drops onto recording medium sheet 2, and after that, all the ink drops which have been landed on recording medium sheet 2 are completely hardened by the second light radiating device 18.

After complete hardening, when the leading edge portion of recording medium sheet 2 is detached from the circumferential surface of conveyance belt 41, recording medium sheet 2 is conveyed by conveyance rollers 11, to be ejected onto output tray 9.

As explained up to now, by image recording apparatus 1*a* of the second embodiment of the present invention, because the first light radiating device 17 is disposed downstream of color printing head 16, which is most downstream among all of the color printing heads (which are printing heads 14, 15, and 16) with respect to conveyance direction X, the color ink drops landed on recording medium sheet 2 are radiated by the first light radiating device 17 to be hardened before the black ink drops are jetted. Further, since the second light radiating device 18 is disposed downstream of black printing head 13 with respect to conveyance direction X, the black ink drops landed on recording media sheets 2 are radiated by the second light radiating device 18 to be hardened.

Therefore, color ink and black ink are not mixed but hardened individually. Especially the black ink drops are landed on recording medium sheet 2, after the color ink drops are hardened, and therefore, it is possible to improve the sharpness of the image, resulting in a sharp color image having sharp image quality.

Still further, in the second embodiment, since the first light radiating device 17 radiates light energy which is greater than that radiated from the second light radiating device 18, it is possible to thoroughly harden the colored ink. The present invention is not limited to the above embodiments, but can be changed as appropriate.

As to the effect of the present invention, in Structure 1, since the first light radiating device is arranged downstream of the black printing head, before the color ink drops are jetted, the first light radiating device radiates the light rays onto the black ink drops which have been landed on the recording medium sheet, and thereby the black ink drops are hardened without mixed with the color ink drops. Accordingly, the color ink drops and the black ink drops are separately hardened without being mixed, resulting in improvement of the image quality of the letters printed in black ink.

In Structure 2, since the second light radiating device radiates light energy which is greater than that radiated from the first light radiating device, hardening is assured.

In Structure 3, the color ink drops landed onto the recording medium sheet are radiated by the first light radiating device and hardened, before the black ink drops are jetted. Further, the black ink drops, landed onto the recording medium sheet after the color ink drops are hardened, are radiated by the first light radiating device to be hardened. Accordingly, the color ink drops and the black ink drops can be separately hardened without being mixed. Especially, the black ink drops are landed onto the recording medium sheet after the color ink drops are hardened, and thereby, it is possible to improve the sharpness of the image, resulting in the color image having the sharp image quality.

In Structure 4, since the first light radiating device radiates light energy which is greater than that radiated from the second light radiating device, hardening is assured.

What is claimed is:

1. An image printing apparatus, comprising:

a conveyance-printing section for printing on a recording medium sheet;

a first printing device including a plurality of first printing heads mounted above the conveyance-printing section and staggered perpendicular to a conveyance direction of the recording medium sheet for jetting a first set of image-setting ink drops onto the recording medium sheet for printing;

a second printing device including a plurality of second printing heads mounted above the conveyance-printing section and staggered perpendicular to the conveyance direction of the recording medium sheet for jetting a second set of image-setting ink drops, respectively, onto the recording medium sheet for printing, the second printing device arranged downstream from the first printing device with respect to the conveyance direction of the recording medium sheet;

a first light radiating device including a plurality of first light sources mounted above the conveyance-printing section and arranged downstream from the first printing device and upstream from the second printing device with respect to the conveyance direction of the recording medium sheet for radiating ultraviolet rays to harden surfaces of the first set of image-setting ink drops jetted from the first printing device before the second set of image-setting ink drops are jetted from the second printing device; and a second light radiating device including a plurality of second light sources mounted above the conveyance-printing section and arranged downstream from the second printing device with respect to the conveyance direction of the recording medium for radiating ultraviolet rays to harden surfaces of the second set of image-setting ink drops jetted from the second printing device, and to completely harden the first set of image-setting ink drops previously jetted from the first printing device, wherein the plurality of first light sources and the plurality of second light sources are staggered perpendicular to the conveyance direction of the recording medium sheet and correspond to each of the plurality of first printing heads and the plurality of the second printing heads, respectively.

2. The image printing apparatus in claim 1, wherein the first printing device and the second printing device are selected from:

a combination of the devices having the plurality of first printing heads as black printing heads for jetting the first set of image-setting ink drops, the first image-setting ink drops being image-setting black ink drops, and having the plurality of second printing heads as color printing heads for jetting the second set of image-setting ink drops, the second set of image-setting ink drops being image-setting cyan, magenta, and yellow color ink drops, and a combination of the devices having the plurality of first printing heads as color printing heads for jetting the first set of image-setting ink drops, the first set of image-setting ink drops being image-setting cyan, magenta, and yellow color ink drops, and having the plurality of second printing heads as black printing heads for jetting the second set of image-setting ink drops, the second set of image-setting ink drops being image-setting black ink drops.

3. The image printing apparatus in claim 2, wherein energy of the ultraviolet rays radiated from the second light radiating device is greater than energy of the ultraviolet rays radiated from the first light radiating device, in case the combination of the devices, having the plurality of first printing heads as black printing heads for jetting the first set of image-setting ink drops, the first set of image-setting ink drops being image-setting black ink drops, and having the plurality of second printing heads as color printing heads for jetting the second set of image-setting ink drops, the second set of image-setting ink drops being image-setting cyan, magenta, and yellow color ink drops, is selected.

4. The image printing apparatus in claim 2, wherein energy of the ultraviolet rays radiated from the first light radiating device is greater than energy of the ultraviolet rays radiated from the second light radiating device, in case the combination of the devices, having the plurality of first printing heads as color printing heads for jetting the first set of image-setting ink drops, the first set of image-setting ink drops being image-setting cyan, magenta, and yellow color ink drops, and having the plurality of second printing heads as black printing heads for jetting the second set of image-setting ink drops, the second image-setting ink drops being image-setting black ink drops, is selected.

* * * * *